US008903259B2

(12) United States Patent
Mochizuki

(10) Patent No.: US 8,903,259 B2
(45) Date of Patent: Dec. 2, 2014

(54) IMAGE FORMING APPARATUS PREVENTING FAILURE OF RECORDING MATERIAL DETACHMENT FROM CONVEYANCE BELT

(71) Applicant: Canon Kabushiki Kaisha, Tokyo (JP)

(72) Inventor: Jun Mochizuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 30 days.

(21) Appl. No.: 13/648,150

(22) Filed: Oct. 9, 2012

(65) Prior Publication Data

US 2013/0094874 A1 Apr. 18, 2013

(30) Foreign Application Priority Data

Oct. 12, 2011 (JP) ..... 2011-225102

(51) Int. Cl.

| | |
|---|---|
| ***G03G 15/00*** | (2006.01) |
| ***G03G 15/16*** | (2006.01) |
| ***G03G 15/01*** | (2006.01) |

(52) U.S. Cl.

CPC .... *G03G 15/0189* (2013.01); *G03G 2215/0129* (2013.01); *G03G 2215/00573* (2013.01); *G03G 15/6558* (2013.01); *G03G 2215/00599* (2013.01)

USPC ..... 399/66; 399/101; 399/312

(58) Field of Classification Search

USPC ..... 399/312

See application file for complete search history.

(56) References Cited

U.S. PATENT DOCUMENTS

2009/0033955 A1* 2/2009 Harigai
2011/0097096 A1 4/2011 Sueoka

FOREIGN PATENT DOCUMENTS

JP 2011-095368 A 5/2011

* cited by examiner

*Primary Examiner* — Clayton E Laballe
*Assistant Examiner* — Jas Sanghera
(74) *Attorney, Agent, or Firm* — Canon USA Inc. IP Division

(57) ABSTRACT

A method controls the timing of conveying a recording material to a conveyance belt so that a leading edge position of the recording material overlaps with a separation assisting toner image transferred on the conveyance belt in advance to prevent failure of recording material detachment from the conveyance belt.

13 Claims, 12 Drawing Sheets

IMAGE FORMING APPARATUS PREVENTING FAILURE OF RECORDING MATERIAL DETACHMENT FROM CONVEYANCE BELT

BACKGROUND OF THE INVENTION

1. Field of the Invention

The claimed invention generally relates to image forming and, more particularly, to an image forming apparatus employing an electrophotographic system or an electrostatic recording system, such as a copying machine and a printer.

2. Description of the Related Art

To apply various types of recording materials particularly thin paper, a certain configuration is provided with a conveyance belt for conveying a recording material and transfers a toner image from an image bearing member onto a recording material conveyed by the conveyance belt. However, since the toner image is electrostatically transferred from the image bearing member onto the conveyance belt, the recording material after the toner image transfer electrostatically adheres to the conveyance belt. In order to convey the recording material after the toner image transfer toward a fixing unit for fixing the toner image, a unit is used for detaching the recording material from the conveyance belt. As a conventional unit for detaching a recording material after the toner image transfer from a conveyance belt, Japanese Patent Application Laid-Open No. 2011-95368 discusses the use of a separation roller for stretching the conveyance belt to detach the recording material therefrom.

However, if there is no intermediary between the rear surface of the recording material and the conveyance belt, a space hardly occurs therebetween and accordingly the rear surface of the recording material is likely to be firmly attached to the conveyance belt. As a result, even when the leading edge of the recording material after the toner image transfer reaches the position of the separation roller, the recording material may not be detached from the conveyance belt. Meanwhile, if toner is transferred onto the conveyance belt, the toner between the rear surface of the leading edge of the recording material and the conveyance belt serves as an intermediary for weakening the adhesiveness between the recording material and the conveyance belt. However, if toner is transferred onto the entire surface of the conveyance belt, the toner can prevent the rear surface of the recording material from firmly adhering to the conveyance belt but may cause another issue that the conveyance belt is excessively smeared. Accordingly, there is a need for a method for suppressing the adhesiveness between the rear surface of the leading edge of the recording material and the conveyance belt because of no intermediary therebetween, without excessively smearing the conveyance belt with a simple configuration.

SUMMARY OF THE INVENTION

According to an aspect of the claimed invention, an image forming apparatus includes a movable image bearing member, an image forming unit configured to form a toner image on the image bearing member, a movable endless conveyance belt configured to bear and convey a recording material, a transfer member configured to transfer a toner image formed on the image bearing member onto a recording material supported by the conveyance belt, and a control unit configured to control a timing of feeding a recording material to the conveyance belt so that a part of the recording material including at least a leading edge of the recording material overlaps with a toner layer, the toner layer being transferred in advance to the conveyance belt from the image bearing member, and having a charging polarity being the same as that of a toner image transferred from the image bearing member onto the recording material, and having a length such that, when the part of the recording material including at least a leading edge of the recording material overlaps with the toner layer, the other part of the recording material does not overlap with the toner layer.

According to the claimed invention, failure of recording material detachment from a conveyance belt due to high adhesiveness between the recording material and the conveyance belt can be prevented without excessively smearing the conveyance belt in a simple configuration.

Further features and aspects of the claimed invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the claimed invention and, together with the description, serve to explain the principles of the claimed invention.

DESCRIPTION OF THE EMBODIMENTS

Various exemplary embodiments, features, and aspects of the claimed invention will be described in detail below with reference to the drawings.

(Entire Configuration and Operation of an Image Forming Apparatus)

Figure 1:
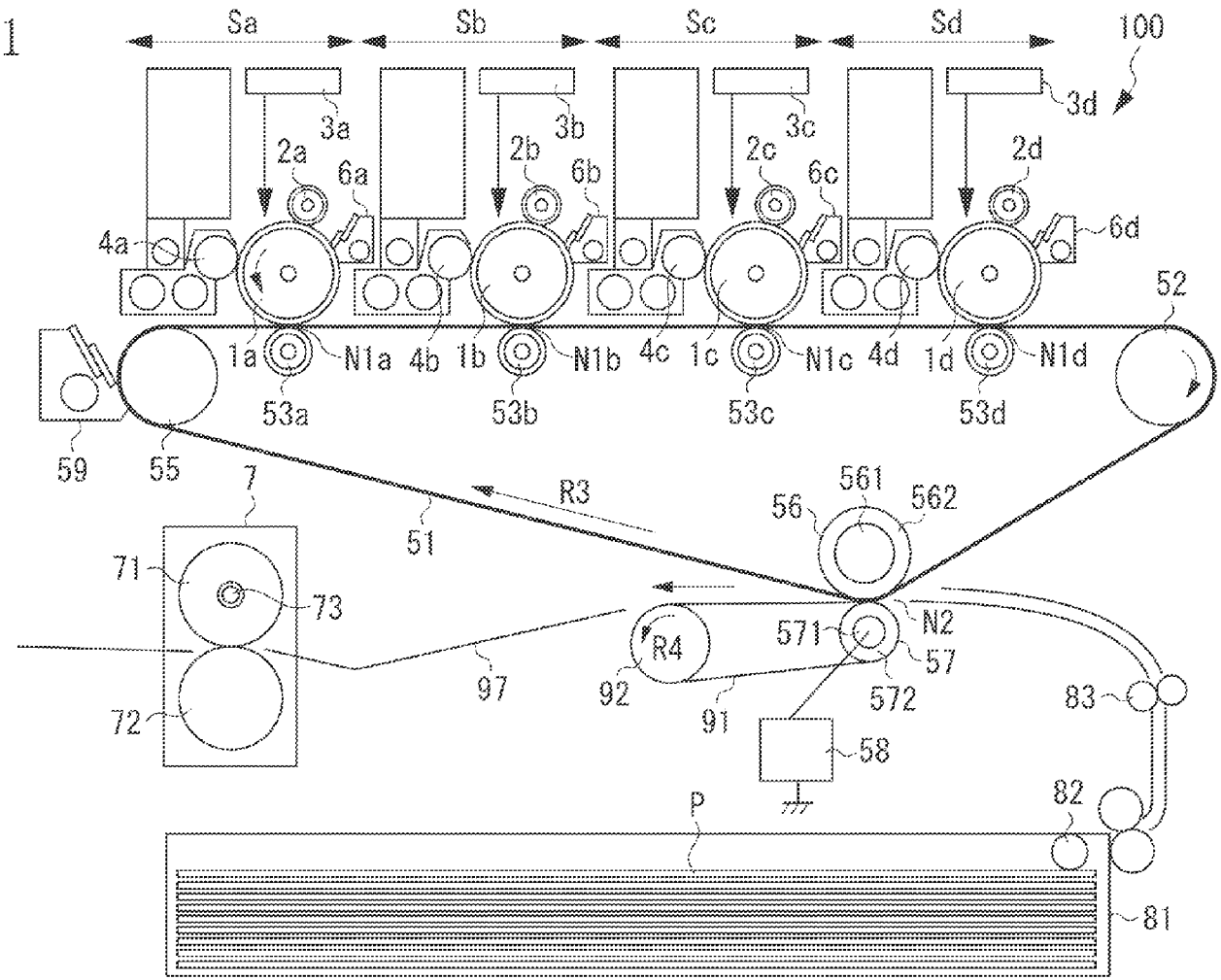
FIG. 1 is a schematic cross sectional view illustrating an image forming apparatus according to a first exemplary embodiment of the claimed invention.

First, an entire configuration and operation of an image forming apparatus according to a first exemplary embodiment of the claimed invention will be described below. FIG. 1 is a schematic cross sectional view illustrating an image forming apparatus 100 according to the present exemplary embodiment.

The image forming apparatus 100 includes image forming units Sa, Sb, Sc, and Sd (process units) for respectively forming a toner image. The image forming units Sa, Sb, Sc, and Sd form toner images of yellow, magenta, cyan, and black colors, respectively. Each of the image forming units Sa, Sb, Sc, and Sd includes a similar configuration except that these units use different colors of the toner. Therefore, descriptions will be made based on the image forming unit Sa.

The image forming unit Sa includes a photosensitive drum 1*a* as an image bearing member, a charging roller 2*a* as a charging unit for charging the surface of photosensitive drum 1*a*, and a laser scanner 3*a* as an exposure unit for exposing the surface of the charged photosensitive drum 1*a* to light. The image forming unit Sa further includes a developing device 4*a* as a developing unit for developing the toner image, and a primary transfer roller 53*a* as a primary transfer unit for transferring the toner image from the photosensitive drum 1*a* onto an intermediate transfer belt 51. As the photosensitive drum 1*a* is rotatably driven, the surface of the photosensitive drum 1*a* is charged by the charging roller 2*a*.

When the charged surface of the photosensitive drum 1*a* is exposed to the light by the laser scanner 3*a*, an electrostatic latent image is formed on the photosensitive drum 1*a*. The electrostatic latent image is formed when the output of the laser scanner 3*a* is turned ON or OFF based on image information. A developing device 4*a* includes yellow toner. A predetermined voltage is applied to the developing device 4*a*. When the electrostatic latent image passes through the developing device 4*a*, it is developed and a toner image is formed on the surface of the photosensitive drum 1*a*. The developing device 4*a* employs the reversal developing method with which toner is applied only to exposed portions of the electrostatic latent image to develop a toner image.

The primarily transfer roller 53*a* is arranged so as to press the photosensitive drum 1*a* via the intermediate transfer belt 51 to form a primary transfer nip portion N1*a* at which the toner image is transferred onto the intermediate transfer belt 51. When a primary transfer power supply (not illustrated) applies a primary transfer voltage to the primary transfer roller 53*a*, the toner image on the photosensitive drum 1*a* is transferred onto the intermediate transfer belt 51. Residual toner on the photosensitive drum 1*a* is cleaned by a drum cleaner 6*a*.

The primary transfer roller 53*a* is formed of a core having an outer diameter of 8 mm and a conductive urethane sponge layer having a thickness of 4 mm. An electrical resistance value of the primary transfer roller 53*a* was about $10^6\Omega$ (23° C. and 50% RH). The electrical resistance value of the primary transfer roller 53*a* is obtained based on a current value which is measured by rotating at a circumferential speed of 50 mm/sec the primary transfer roller 53*a* contacting a metal roller grounded under a 500 gram weight load and applying a 50 V voltage to the core.

When a full-color image is formed by toner of a plurality of colors, toner images of respective colors are transferred onto the intermediate transfer belt 51 at respective primarily transfer nip portions.

The intermediate transfer belt 51 functions as an intermediate transfer member for bearing and conveying the toner images transferred from the photosensitive drums 1*a*, 1*b*, 1*c*, and 1*d*. The intermediate transfer belt 51, i.e., a movable belt member, is arranged such that its outer circumferential surface contacts the surfaces of the photosensitive drums 1*a*, 1*b*, 1*c*, and 1*d*, and stretched by a plurality of supporting members 52, 55, and 56. The intermediate transfer belt 51 is formed of a polyimide (PI) resin having a surface resistivity of $10^{12}\Omega/\square$ (measured by a probe conforming to the JIS-K6911 standard, a 100 V voltage applied for 60 seconds at 23° C. and 50% RH) and a thickness of 80 μm. Of course, the configuration is not limited thereto. The intermediate transfer belt 51 may be made from a dielectric resin such as polycarbonate (PC), polyethylene terephthalate (PET), polyvinylidene fluoride (PVDF), etc.

An intermediate transfer belt driving roller 52 drives the movement of the intermediate transfer belt 51. A secondary transfer inner roller 56 transfers the toner image from the intermediate transfer belt 51 onto a recording material (described in detail below). Upon receiving a driving force of the intermediate transfer belt driving roller 52 serving as a belt driving member, the intermediate transfer belt 51 circumferentially moves in the direction indicated by an arrow R3 in FIG. 1. With the movement of the intermediate transfer belt 51, the toner image thereon is conveyed to a secondary transfer nip portion N2 at which the toner image is transferred onto the recording material.

A transfer conveyance belt 91, i.e., a movable belt member, for bearing and conveying the recording material is stretched by a plurality of stretching members 57 and 92. The transfer conveyance belt 91 is movable in the direction indicated by an arrow R4 in FIG. 1. A secondary transfer outer roller 57 and the secondary transfer inner roller 56 function as secondary transfer members for forming a secondary transfer nip portion N2. The secondary transfer outer roller 57 is arranged at a position facing the secondary transfer inner roller 56 to press the secondary transfer inner roller 56 via the intermediate transfer belt 51 and the transfer conveyance belt 91, thus forming the secondary transfer nip portion N2. The stretching roller 92 serves as a drive roller for driving the movement of the transfer conveyance belt 91.

The transfer conveyance belt 91 is formed of a carbon-dispersed polyimide (PI) resin having a surface resistivity of $10^{14}\Omega/\square$ (measured by using a probe conforming to the JIS-K6911 standard, a 1000 V voltage applied for 60 seconds at 23° C. and 50% RH) and a thickness of 80 μm. Of course, the material of the transfer conveyance belt 91 is not limited thereto. The transfer conveyance belt 91 may be made from a dielectric resin such as PC, PET, PVDF, etc.

The secondary transfer inner roller 56 is formed of a core 561 having an outer diameter of 18 mm and a conductive solid silicon rubber layer 562 having a thickness of 2 mm. The electrical resistance value of the secondary transfer inner roller 56 was about $10^4\Omega$ with the same measurement method as that used for the primary transfer roller 53*a*. The secondary transfer outer roller 57 is formed of a core 571 having an outer diameter of 8 mm and a conductive ethylene propylene diene monomer (EPDM) rubber sponge layer 572 having a thickness of 4 mm. The electrical resistance value of the secondary transfer outer roller 57 was about $10^7\Omega$ with the same measurement method as that used for the primary transfer roller 53*a* when an applied voltage was 2000 V.

Recording materials are stored in a sheet cassette 81 as a recording material storage unit. A pickup roller 82 picks up a recording material from the sheet cassette 81 as the recording material storage unit. Then, a conveyance roller pair 83 sends out the recording material toward the transfer conveyance belt 91. The timing at which the conveyance roller pair 83 sends out the recording material toward the transfer conveyance belt 91 is controlled so that the toner image to be transferred onto a surface of the recording material overlaps with the surface of the recording material at the secondary transfer nip portion N2.

A secondary transfer voltage power supply 58 functions as a secondary transfer voltage application unit for applying to the secondary transfer outer roller 57 a secondary transfer voltage for transferring the toner image onto the recording material. When the recording material passes through the secondary transfer nip portion N2, the secondary transfer power supply 58 applies the secondary transfer voltage to the secondary transfer outer roller 57. Thus, at the secondary transfer nip portion N2, the toner image is electrostatically transferred from the intermediate transfer belt 51 onto the recording material borne and conveyed by the transfer conveyance belt 91. The recording material after toner image transfer passes through a conveyance guide 97, and is conveyed to a fixing device 7, i.e., a fixing unit, for fixing the toner image onto the recording material. Toner (secondary transfer residual toner) that has not been transferred onto the recording material at the secondary transfer nip portion N2 but remained on the intermediate transfer belt 51 is removed and collected by an intermediate transfer belt cleaner 59.

The fixing device 7 includes a fixing roller 71 rotatably arranged and a pressing roller 72 which rotates while pressuring the fixing roller 71. The fixing roller 71 includes a heater 73 such as a halogen lamp. The temperature of the surface of the fixing roller 71 is controlled by controlling a voltage to be supplied to the heater 73. When a recording material P is conveyed to the fixing device 7, the fixing roller 71 and the pressing roller 72 start rotating at a constant speed. When the recording material P passes through a gap between the fixing roller 71 and the pressing roller 72, the fixing roller 71 and the pressing roller 72 respectively apply heat and pressure to the recording material P at almost constant temperature and pressure from both sides of the recording material P. Thus, an unfixed toner image on the surface of the recording material P is melted and fixed onto the recording material P. Then, image formation on the recording material P is completed.

(Control Unit for Forming a Separation Assisting Toner Image)

Since toner image transfer is electrostatically performed at the secondary transfer nip portion N2, a recording material after the toner image transfer is likely to electrostatically adhere to the transfer conveyance belt 91. After the toner image transfer, to convey the recording material toward the fixing device 7 arranged on the downstream side, the recording material is detached from the transfer conveyance belt 91. According to the present exemplary embodiment, the stretching roller 92 arranged on the downstream side of the secondary transfer nip portion N2 in the recording material conveyance direction also functions as a separation roller for detaching the recording material. However, if there is no intermediary between the rear surface of the recording material and the transfer conveyance belt 91, a space hardly occurs therebetween and accordingly the rear surface of the recording material is likely to be firmly attached to the transfer conveyance belt 91. As a result, even when the leading edge of the recording material after the toner image transfer reaches the position of the separation roller (stretching roller 92), the recording material may not possibly be detached from the transfer conveyance belt 91. Thus, there is a need for a method for suppressing, with a simple configuration, the adhesiveness between the rear surface of the leading edge of the recording material and the conveyance belt because of no intermediary therebetween.

According to the present exemplary embodiment, a separation assisting toner image having a length shorter than a length of the transfer conveyance belt 91 is formed and transferred from the intermediate transfer belt 51 onto the transfer conveyance belt 91. The timing at which the recording material is conveyed to the transfer conveyance belt 91 is controlled so that the rear surface of the leading edge of the recording material overlaps with the separation assisting toner image. More specifically, according to the size of the recording material and the length of the transfer conveyance belt 91, an interval between recording materials and a forming position of the separation assisting toner image are adjusted.

As a result, a detachment assisting toner layer serves as an intermediary between the transfer conveyance belt 91 and the rear surface of the leading edge of the recording material, and the recording material is hardly firmly attached to the transfer conveyance belt 91. Thus, a situation where the recording material is not detached from the transfer conveyance belt 91 can be suppressed.

Figure 2:
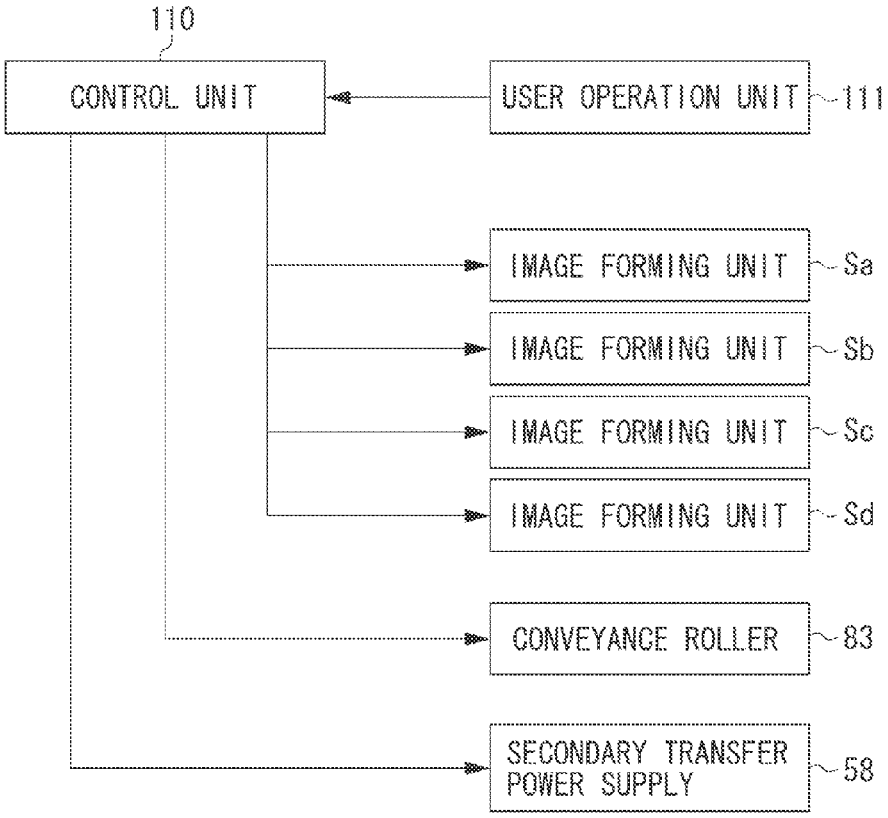
FIG. 2 is a block diagram illustrating a control unit.

A control unit for forming a separation assisting toner image will be described below. According to the present exemplary embodiment, an operation for forming a separation assisting toner image is controlled by a control unit 110, as illustrated in FIG. 2. The control unit 110 receives a size information signal indicating the size of the recording material in the conveyance direction input from a user operation unit 111. The control unit 110 includes a random access memory (RAM), a read-only memory (ROM), and a central processing unit (CPU). The ROM records information about a circumferential length of the intermediate transfer belt in the moving direction. The control unit 110 controls the timing of starting image formation in each image forming units Sa, Sb, Sc, and Sd based on information about the size of the recording material and information about the size of the intermediate transfer belt 51. The control unit 110 also controls the timing at which the conveyance roller pair 83 sends out a recording material to the transfer conveyance belt 91.

The ROM in the control unit 110 records the following patterns.

When a one-sheet job (described below) is performed, a separation assisting toner image formed by the image forming unit Sa is transferred from the intermediate transfer belt 51 onto the transfer conveyance belt 91. Further, before the separation assisting toner image makes a circuit along the transfer conveyance belt 91, the rear surface of the leading edge of the recording material overlaps with the separation assisting toner image, and the toner image to be formed on the recording material is transferred onto the surface of the recording material. To achieve the image formation operation in this way, the control unit 110 controls the timing of forming an image on the surface of a recording material at each of the image forming units Sa, Sb, Sc, and Sd, the timing of forming a separation assisting toner image by the image forming unit Sa, and the timing of conveying the recording material via the conveyance roller pair 83.

The ROM of the control unit 110 further records the following patterns. In this case, a separation assisting toner image has a length "b" in the transfer conveyance belt moving direction. A length "c" corresponds to the circumferential length of the transfer conveyance belt 91 in the recording material conveyance direction. A distance "e" is from a trailing edge of the separation assisting toner image to the leading edge of the recording material following the separation assisting toner image in the transfer conveyance belt moving direction. A distance "f" is from the leading edge of the recording material to the leading edge of the following recording material in the transfer conveyance belt moving direction. "N" is any positive integer or zero.

When an image is successively formed on a plurality of recording materials, relations "$c<Nf+b+e$", "$Nf+e<c$", and "$Nf+b<c$" are satisfied. To satisfy these relations, the control unit 110 controls the timing of forming an image on the surface of a recording material at each of the image forming units Sa, Sb, Sc, and Sd, the timing of forming a separation assisting toner image via the image forming unit Sa, and the timing of conveying the recording material via the conveyance roller pair 83.

Figure 3:
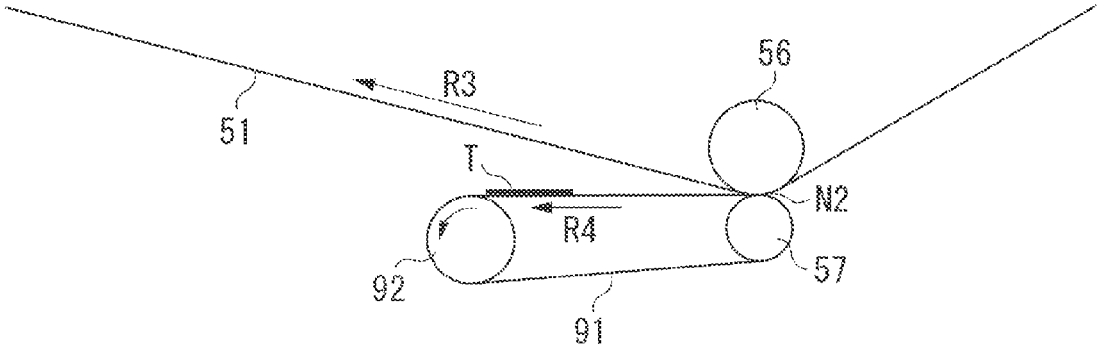
FIG. 3 schematically illustrates a recording material detaching operation.
Figure 4:
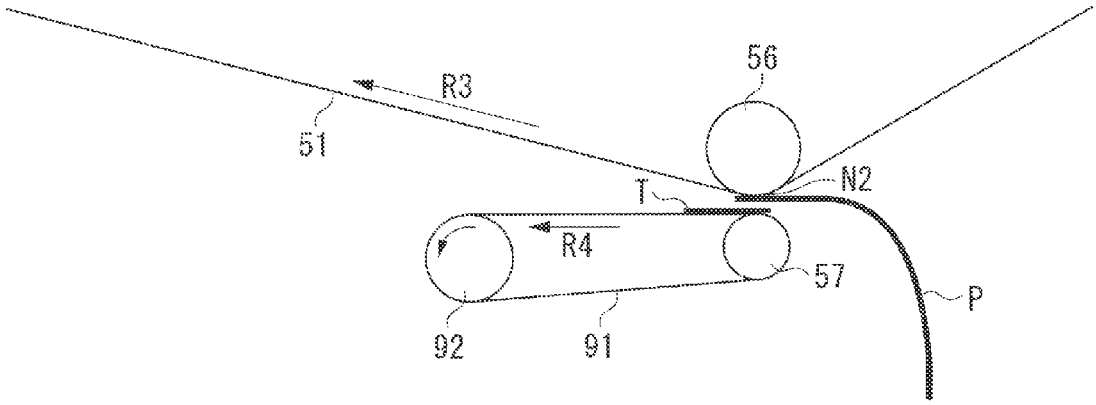
FIG. 4 schematically illustrates a recording material detaching operation.
Figure 5:
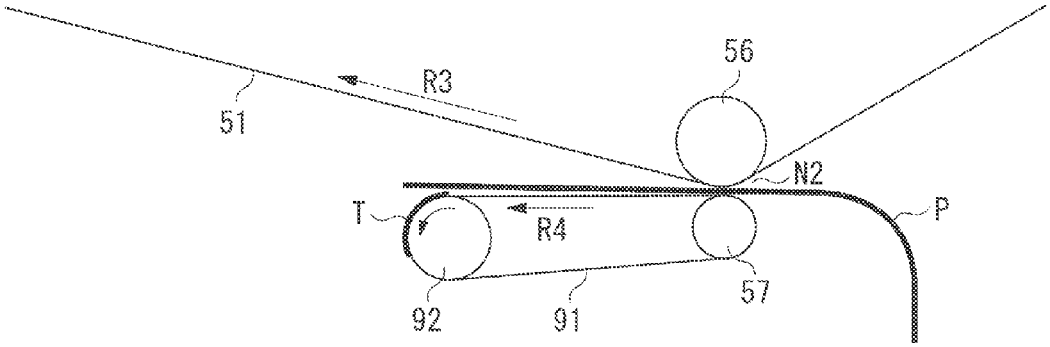
FIG. 5 schematically illustrates a recording material detaching operation.

(Process for Using the Separation Assisting Toner Image) The following describes in detail how the detachment of a recording material is assisted by forming a separation assisting toner image with reference to FIGS. 3 to 5.

Before a toner image Ts to be formed on the surface of the recording material is formed on each of the photosensitive drums 1*a*, 1*b*, 1*c*, and 1*d*, a separation assisting toner image T for assisting the detachment from the recording material is formed. As the separation assisting toner image T, a thin layer yellow toner image is formed on the photosensitive drum 1*a*. The length of the separation assisting toner image T is set shorter than the length of the transfer conveyance belt 91 in the transfer conveyance belt moving direction. More specifically, since the separation assisting toner image T is not formed on the entire surface of the transfer conveyance belt 91, the transfer conveyance belt 91 is prevented from being excessively smeared.

A yellow toner has the highest lightness among toners used with the image forming apparatus according to the present exemplary embodiment. Therefore, even if the yellow toner adheres to the rear surface of a recording material, it is not conspicuous as a smear. Thus, it is desirable to use a yellow toner for a separation assisting toner image. As for an amount of the toner for a separation assisting toner image, even if the toner adheres to the rear surface of the recording material while securing the detachment of the recording material, the toner is not conspicuous. Therefore, the toner loaded amount per unit area on the transfer conveyance belt 91 is desirably between 0.01 mg/cm$^2$ and 0.04 mg/cm$^2$ (inclusive) or around. In a width direction perpendicular to the transfer conveyance belt moving direction, the width of the separation assisting toner image T is set to the same value as the maximum value of the image forming width.

The separation assisting toner image T formed on the photosensitive drum 1*a* is transferred onto the intermediate transfer belt 51 at the primary transfer portion N1*a*. The absolute value of the voltage to be applied to the primary transfer roller 53*a* is set to an absolute value (second absolute value) lower than the absolute value (first absolute value) of the transfer voltage for transferring the toner image to be formed on the surface of the recording material at the primary transfer portion N1*a*.

One reason for setting the voltage as described above is that a recording material does not exist when the separation assisting toner image T is directly transferred onto the intermediate transfer belt 51. Therefore, a transfer voltage necessary to apply a predetermined current can be reduced by the amount for the recording material. In addition, the amount of toner for the separation assisting toner image T is less than the amount of toner for a toner image to be formed on the surface of the recording material. Therefore, applying a voltage having a large absolute value to the primarily transfer roller 53*a* causes discharge, and possibly causes inversion of the polarity of the toner image. As a result, the efficiency of transferring the separation assisting toner image may be reduced. Then, to prevent the reduction of the efficiency of transferring the separation assisting toner image Ts onto the intermediate transfer belt 51, the voltage to be applied to the primarily transfer roller 53*a* is set lower than the voltage at the time of regular image formation.

The above-described regular image formation refers to transferring a toner image to be formed on the surface of the recording material from the photosensitive drum 1*a* onto the intermediate transfer belt 51. When the separation assisting toner image T passes through primary transfer nip portions N1*b*, N1*c*, and N1*d* for magenta, cyan, and black colors, respectively, on the downstream side on the intermediate transfer belt 51, a voltage having a lower absolute value than that at the time of regular image formation is applied to respective primary transfer rollers 53*b*, 53*c*, and 53*d*. As a result, the separation assisting toner image T can be prevented from being re-transferred onto the photosensitive drums 1*b*, 1*c*, and 1*d* by discharge. It is also possible to make setting so that a voltage is not applied to the respective primary transfer rollers 53*b*, 53*c*, and 53*d* when the separation assisting toner image T passes through the primary transfer nip portions N1*b*, N1*c*, and N1*d*.

When the separation assisting toner image T on the intermediate transfer belt 51 reaches the secondary transfer nip portion N2, a voltage is applied to the secondary transfer outer roller 57 and the separation assisting toner image T is transferred onto the transfer conveyance belt 91. Also in this case, the absolute value of the voltage to be applied to the secondary transfer outer roller 57 is set lower than the absolute value at the time of regular image formation. Thus, the toner layer transferred onto the transfer conveyance belt 91 includes a small amount of inverted toner. The above-described regular image formation refers to transferring a toner image to be formed on the surface of the recording material from the intermediate transfer belt 51 to the recording material.

As illustrated in FIG. 3, the separation assisting toner image T transferred onto the transfer conveyance belt 91 moves along the transfer conveyance belt 91 in the moving direction R4 of the transfer conveyance belt 91. Meanwhile, the conveyance roller pair 83, i.e., a conveyance unit, for conveying a recording material P toward the transfer conveyance belt 91 conveys the recording material P to the proximity of the transfer conveyance belt 91.

As illustrated in FIG. 4, the conveyance roller pair 83 conveys the recording material P so that the leading edge of the rear surface of the recording material P overlaps with the separation assisting toner image T on the transfer conveyance belt 91. Then, when the secondary transfer voltage is applied to the secondary transfer outer roller 57, the toner image to be formed on the recording material is transferred from the intermediate transfer belt 51 onto the recording material P. Since the separation assisting toner image T is formed of the toner having a normal polarity (toner charging polarity), the separation assisting toner image T is attracted toward the side of the transfer conveyance belt 91 by the secondary transfer voltage. As a result, the separation assisting toner image T is prevented from adhering to the rear surface of the recording material P.

After exiting the secondary transfer nip portion N2, the recording material P further moves toward the downstream side of the transfer conveyance belt 91. As illustrated in FIG. 5, when the leading edge of the recording material P comes to the position of the stretching roller 92, the recording material P is detached from the transfer conveyance belt 91 by self stripping utilizing the curvature of the stretching roller 92 (also referred to as a transfer conveyance belt driving roller 92). Since the separation assisting toner image T serves as an intermediary between the rear surface of the leading edge of the recording material P and the transfer conveyance belt 91, the recording material P is prevented from adhering to the transfer conveyance belt 91. Therefore, even if the recording material P is thin paper having low stiffness, the recording material P is prevented from adhering to the transfer conveyance belt 91, and detachment failure can be suppressed.

In a subsequent non-image formation period, when a bias voltage having the polarity opposite to that at the time of regular image formation is applied to the secondary transfer outer roller 57, the separation assisting toner image T formed on the transfer conveyance belt 91 is re-transferred onto the intermediate transfer belt 51. Then, the intermediate transfer belt cleaner 59 (image bearing member cleaning member) collects the separation assisting toner image T.

(Positional Relation of the Separation Assisting Toner Image in the Recording Material Conveyance Direction)

Figure 6:
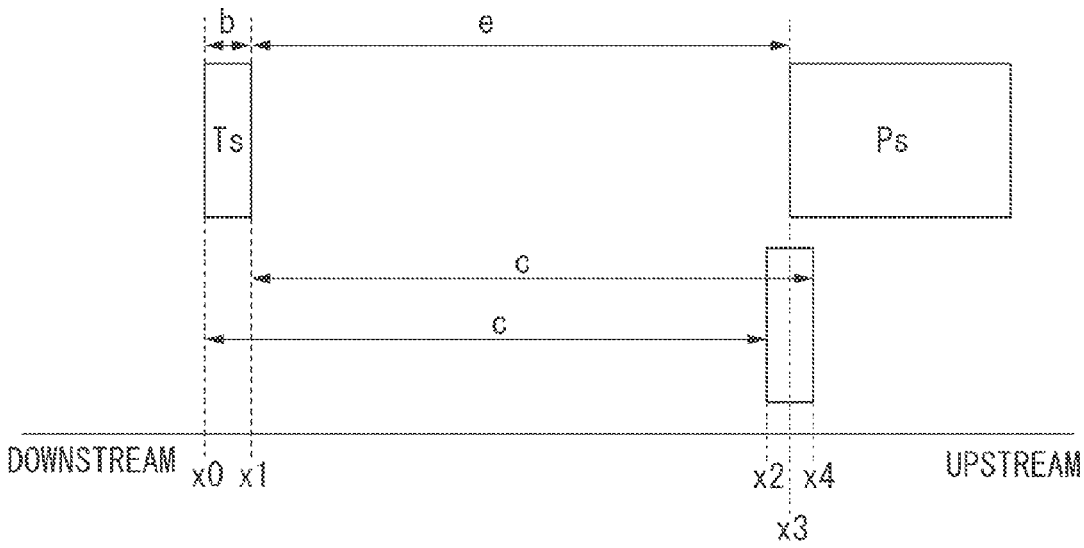
FIG. 6 illustrates a positional relation in a recording material conveyance direction.
Figure 7:
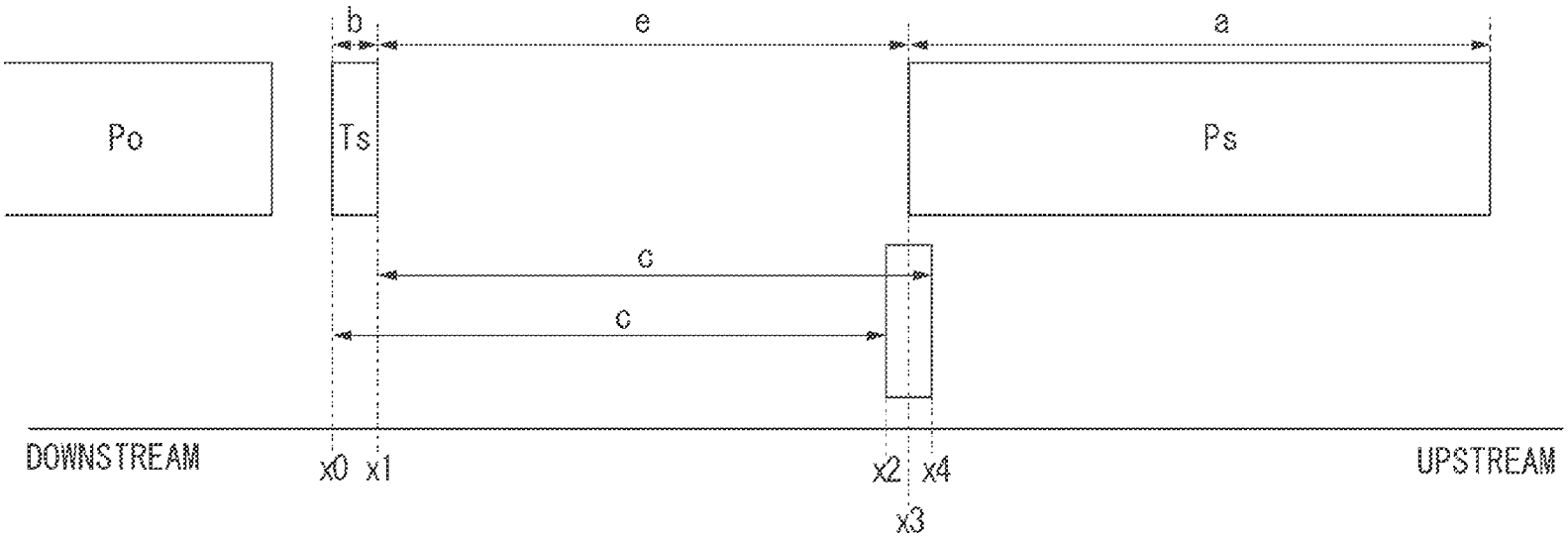
FIG. 7 illustrates a positional relation in the recording material conveyance direction.
Figure 8:
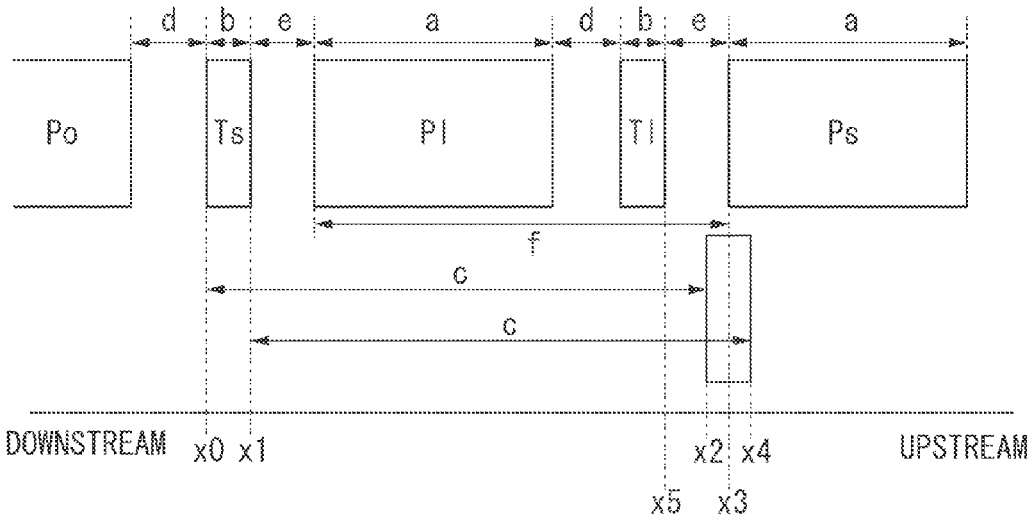
FIG. 8 illustrates a positional relation in the recording material conveyance direction.

The following describes a positional relation between a separation assisting toner image and a recording material in the recording material conveyance direction, with reference to FIGS. 6 to 8.

A case of a one-sheet job (a job with which one sheet is specified by a user) will be described below with reference to FIG. 6. Referring to FIG. 6, the horizontal axis indicates a positional relation in the recording material conveyance direction. The right-hand side indicates the upstream side and the left-hand side indicates the downstream side. In FIG. 6, "x0" indicates a position where the leading edge of the separation assisting toner image Ts is first transferred onto the transfer conveyance belt 91. "x1" indicates a position where the trailing edge of the separation assisting toner image Ts is transferred onto the transfer conveyance belt 91. "x2" indicates a position of the leading edge of the separation assisting toner image Ts when the separation assisting toner image Ts has made a circuit along the transfer conveyance belt 91 and returned to the former position. "x3" indicates a position of the leading edge of a recording material Ps. "x4" indicates a position of the trailing edge of the separation assisting toner image Ts when the separation assisting toner image Is has made a circuit along the transfer conveyance belt 91 and returned to the former position.

According to the present exemplary embodiment, a relation "x2<x3" (Formula 1) is satisfied. This means that the leading edge of the separation assisting toner image Ts that has made a circuit along the transfer conveyance belt 91 and returned to the former position comes to on more downstream side than the leading edge of the recording material Ps. Further, a relation "x3<x4" (Formula 2) is satisfied. This means that the trailing edge of the separation assisting toner image Ts that has made a circuit along the transfer conveyance belt 91 and returned to the former position comes to on more upstream side than the leading edge of the recording material Ps. Thus, since a relation "x2<x3<x4" is satisfied, the leading edge of the rear surface of the recording material Ps overlaps with the separation assisting toner image Ts that has made a circuit along the transfer conveyance belt 91 and returned to the former position.

Here, the separation assisting toner image Ts has a length "b" in the recording material conveyance direction. A length "c" corresponds to the circumferential length of the transfer conveyance belt 91 in the recording material conveyance direction. An interval "e" is a distance from the trailing edge of the separation assisting toner image Ts when transferred at the secondary transfer nip portion N2 to the leading edge of the recording material Ps in the recording material conveyance direction. The position (x2, x4) of the separation assisting toner image Ts when the separation assisting toner image Ts has made a circuit along the transfer conveyance belt 91 and returned to the former position is on more upstream side by the length "c" than the position (x0, x1) of the separation assisting toner image Ts first transferred onto the transfer conveyance belt 91 in the recording material conveyance direction. More specifically, relations "b=x1−x0", "x2−x0=x4−x1=c", and "x3−x1=e" are satisfied.

In this case, the formula 1 is represented as follows:

$$x2<x3$$

$$x2-x0<x3-x0$$

$$c<b+e \qquad \text{(Formula 3)}$$

The formula 2 is represented as follows:

$$x4>x3$$

$$x4-x1>x3-x1$$

$$c>e \qquad \text{(Formula 4)}$$

Further, according to the present exemplary embodiment, a relation "x1<x2" is satisfied so that the trailing edge of the separation assisting toner image Ts does not overlap with the separation assisting toner image Ts that has made a circuit along the transfer conveyance belt 91 and returned to the former position.

This relation is represented by "b" and "c" as follows:

$$x1<x2$$

$$x1-x0<x2-x0$$

$$b<c \qquad \text{(Formula 5)}$$

More specifically, the control unit 110 controls the length "b" of the separation assisting toner image Is in the recording material conveyance direction, and the positional relation between the separation assisting toner image Is and the recording material Ps in the recording material conveyance direction so as to satisfy not only the relations represented by the formulas 3 and 4 but also the relations represented by the formula 5.

The configuration and operation for stably detaching a recording material such as thin paper from the transfer conveyance belt 91 in the case of a one-sheet job according to the present exemplary embodiment has specifically been described.

The operation for successive image formation performed on a plurality of recording materials will be described below. When a plurality of recording materials is successively supplied, the following operations are used so that a separation assisting toner image constantly exists at least at the leading edge of the rear surface of the recording materials. More specifically, after forming a separation assisting toner image between images successively formed on the intermediate transfer belt 51, the control unit 110 transfers the separation assisting toner image onto the transfer conveyance belt 91. When the separation assisting toner image reaches the secondary transfer nip portion N2 before the transfer conveyance belt 91 has made a circuit, the control unit 110 supplies the next recording material. The following describes a positional relation in the transfer conveyance belt moving direction during operations of a successive image formation job (a job with which successive image formation on a plurality of recording materials is specified by a user), with reference to FIGS. 7, 8, and 9.

The following describes a case where a length "a" of a recording material in the recording material conveyance direction is slightly longer than the circumferential length c of the transfer conveyance belt 91 (a>c), with reference to FIG. 7. When the size of recording materials is large, a separation assisting toner image Ts assists the detachment of a recording material Ps conveyed following the separation assisting toner image Ts.

The separation assisting toner image Ts is transferred from the intermediate transfer belt 51 onto the transfer conveyance belt 91 at a position between the trailing edge of a recording material P0 and the leading edge of the recording material Ps following the recording material P0 in the recording material conveyance direction.

In FIG. 7, "x0" indicates the position of the leading edge of the separation assisting toner image Ts when transferred from the intermediate transfer belt 51. "x1" indicates the position of the trailing edge of the separation assisting toner image Ts when transferred from the intermediate transfer belt 51. "x2" indicates the position of the leading edge of the separation assisting toner image Ts when the separation assisting toner image Ts has made a circuit along the transfer conveyance belt 91 and returned to the former position. "x3" indicates the position of the leading edge of the recording material Ps. "x4" indicates the position of the trailing edge of the separation assisting toner image Ts when the separation assisting toner image Ts has made a circuit along the transfer conveyance belt 91 and returned to the former position.

With a successive image formation job, the condition necessary for the rear surface of the leading edge of the recording material Ps to overlap with the separation assisting toner image Ts is the same as the condition for a one-sheet job. More specifically, a relation "x2<x3<x4" is satisfied. In other words, the relations represented by the formulas 3 and 4 are satisfied. As a result, even in the case of a recording material having low stiffness such as thin paper, detachment failure can be prevented from occurring.

The separation assisting toner image for the recording material following the recording material Ps is transferred onto the transfer conveyance belt 91 at a position between the recording material Ps and the recording material following the recording material Ps. Meanwhile, the separation assisting toner image Ts for the recording material Ps is transferred onto the transfer conveyance belt 91 at a position between the recording material Po preceding the recording material Ps and the recording material Ps. Therefore, the separation assisting toner image Ts for the recording material Ps does not overlap with the separation assisting toner image for the recording material following the recording material Ps. Meanwhile, when the leading edge of the separation assisting toner image Ts has made a circuit along the transfer conveyance belt 91 and returned to the former position, the leading edge of the separation assisting toner image Ts should not overlap with the trailing edge of the separation assisting toner image Ts itself. The condition for that is the same as the condition for a one-sheet job. More specifically, a relation "x1<x2" is satisfied. In other words, the relations represented by the formula 5 are satisfied.

Figure 9:
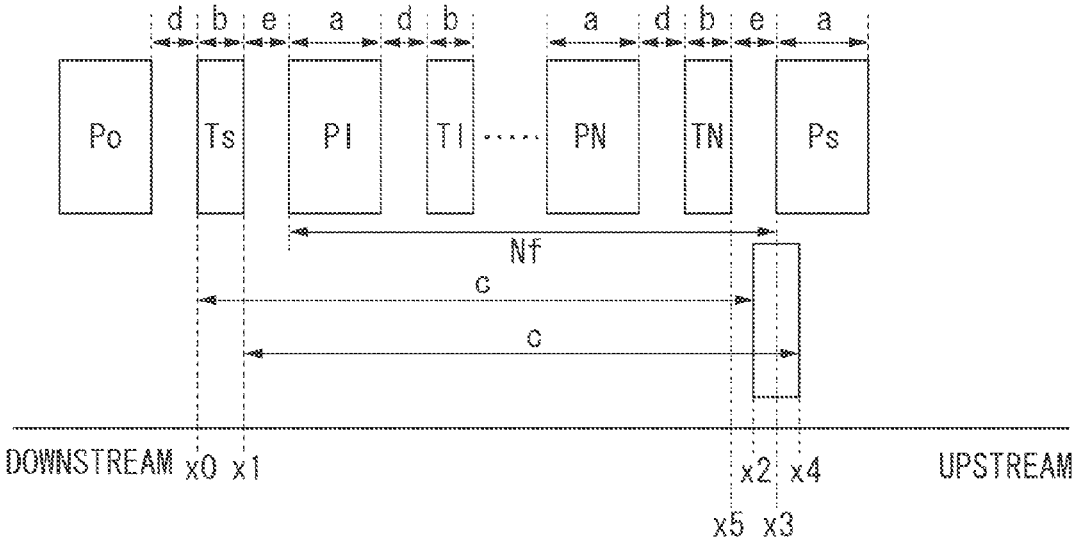
FIG. 9 illustrates a positional relation in the recording material conveyance direction.

The following describes a case where the length "a" of a recording material in the recording material conveyance direction is shorter than the circumferential length "c" of the transfer conveyance belt 91 (a<c), with reference to FIGS. 8 and 9.

FIG. 8 illustrates a case where recording materials P0, P1, and Ps are conveyed in this order. The separation assisting toner image Ts is transferred from the intermediate transfer belt 51 onto the transfer conveyance belt 91 at a position between the trailing edge of the recording material P0 and the leading edge of the recording material P1 in the recording material conveyance direction. Further, a separation assisting toner image T1 for the recording material (not illustrated) following the recording material Ps is transferred onto the transfer conveyance belt 91 at a position between the trailing edge of the recording material P1 and the leading edge of the recording material Ps. More specifically, the recording material P1 and the separation assisting toner image T1 are sandwiched by the recording material Ps whose detachment is to be assisted by the separation assisting toner image Ts and the separation assisting toner image Ts.

Also in this case, the condition necessary for the rear surface of the leading edge of the recording material Ps to overlap with the separation assisting toner image Ts is to satisfy a relation "x2<x3<x4." In FIG. 8, a length "f" is an interval from the leading edge of the preceding recording material P1 to the leading edge of the following recording material Ps. As illustrated in FIG. 8, relations "x2=x0+c", "x3=x0+b+e+f", and "x4=x0+b+c" are satisfied. Based on these relations, the following conditions are obtained:

$$x2<x3$$

$$x0+c<x0+b+e+f$$

$$c<b+e+f \qquad \text{(Formula 6)}$$

Further, the following conditions are obtained:

$$x3<x4$$

$$x0+b+e+f<x0+b+c$$

$$c>e+f \qquad \text{(Formula 7)}$$

"x5" indicates a position where the trailing edge of the separation assisting toner image T1 is transferred from the intermediate transfer belt 51 onto the transfer conveyance belt 91 between the trailing edge of the recording material P1 and the leading edge of the recording material Ps in the recording material conveyance direction. According to the present exemplary embodiment, the position of the leading edge of the separation assisting toner image Ts when the separation assisting toner image Ts has made a circuit along the transfer conveyance belt 91 and returned to the former position, comes to on more upstream side in the recording material conveyance direction than the position of the trailing edge of the following separation assisting toner image T1 so that the following separation assisting toner image T1 does not overlap with the preceding separation assisting toner image Ts. More specifically, a relation "x5<x2" is satisfied. The reason will be described below. When the following separation assisting toner image T1 overlaps with the separation assisting toner image Ts, the amount of toner of the following separation assisting toner image T1 substantially increases. Therefore, the separation assisting toner image T1 may possibly smear the rear surface of the recording material whose detachment is to be assisted by the following separation assisting toner image T1.

According to the present exemplary embodiment, therefore, the following separation assisting toner image T1 is transferred from the intermediate transfer belt 51 onto the transfer conveyance belt 91 so as not to overlap with the separation assisting toner image Ts. As illustrated in FIG. 8, a relation "x5=x0+b+f" is satisfied. Based on this relation, the following conditions are obtained:

$$x5<x2$$

$$x0+b+f<x0+c$$

$$c>b+f \qquad \text{(Formula 8)}$$

The above-described conditions will be summarized below. When the length "a" of the recording material in the recording material conveyance direction is slightly shorter than the circumferential length "c" of the transfer conveyance belt 91, the control unit 110 controls the length "b" of the separation assisting toner image in the recording material conveyance direction and a positional relation between the separation assisting toner image and the recording material in the recording material conveyance direction so as to satisfy the relations represented by the formulas 6, 7, and 8.

The following describes a case where the size of the recording material is further smaller, with reference to FIG. 9. FIG. 9 illustrates a case where recording materials P0, P1, P2, . . . PN, and Ps are conveyed in this order. Further, the separation assisting toner image Ts is transferred from the intermediate transfer belt 51 onto the transfer conveyance belt 91 at a position between the trailing edge of the recording material P0 and the leading edge of the recording material P1. Following the separation assisting toner image Ts, the separation assisting toner image T1 is transferred onto the transfer conveyance belt 91 at a position between the trailing edge of the recording material P1 and the leading edge of the recording material P2 in the recording material conveyance direction. Likewise, following the separation assisting toner image T1, each of separation assisting toner images T2 to TN is transferred onto the transfer conveyance belt 91 at a position between the trailing edge of the relevant preceding recording material and the leading edge of the relevant following recording material. The separation assisting toner image Ts assists the detachment of the recording material Ps. More specifically, N pieces on the recording materials P1 to PN and N pieces of the separation assisting toner images T1 to TN are sandwiched by the separation assisting toner image Ts and the recording materials Ps whose detachment is to be assisted by the separation assisting toner image Ts.

Also in this case, the condition necessary for the leading edge of the rear surface of the recording material Ps to overlap with the separation assisting toner image Ts is "x2<x3<x4." As illustrated in FIG. 9, the position of the leading edge of the recording material Ps is represented by "x3=x0+b+e+Nf." Based on this relation of x3, the following conditions are obtained:

$$x2<x3$$

$$x0+c<x0+b+e+Nf$$

$$c<b+e+Nf \quad \text{(Formula 9)}$$

Further, based on the relation of x3, the following conditions are obtained:

$$x3<x4$$

$$x0+b+e+Nf<x0+b+c$$

$$c>e+Nf \quad \text{(Formula 10)}$$

To suppress the excessive amount of toner for the separation assisting toner images, it is desirable that the separation assisting toner image TN to be transferred onto the transfer conveyance belt 91 immediately before the recording material Ps does not overlap with the separation assisting toner image Ts. Accordingly, in the present exemplary embodiment, the trailing edge of the separation assisting toner image TN comes to on more downstream side than the leading edge of the separation assisting toner image Ts in the recording material conveyance direction. More specifically, a relation "x5<x2" is satisfied. As illustrated in FIG. 9, the position x5 of the trailing edge of the separation assisting toner image TN is represented by "x5=x0+b+Nf." Based on this relation of x5, the following conditions are obtained:

$$x5<x2$$

$$x0+b+Nf<x0+c$$

$$c>b+Nf \quad \text{(Formula 11)}$$

The above-described conditions will be summarized below. When the size of the recording material is further smaller, the control unit 110 controls the length "b" of a separation assisting toner image in the recording material conveyance direction and a positional relation between the separation assisting toner image and the recording material in the recording material conveyance direction so as to satisfy the relations represented by the formulas 9, 10, and 11.

The formulas have specifically been described above for three different cases: a case of a one-sheet job, a case of a successive image formation job in which the size of the recording material is longer than the circumferential length of the transfer conveyance belt 91, and a case of a successive image formation job in which the size of the recording material is shorter than the circumferential length of the transfer conveyance belt 91. In the case of a one-sheet job and the case of a successive image formation job in which the size of the recording material is longer than the circumferential length of the transfer conveyance belt 91, the formulas 3, 4, and 5 are obtained. Further, in the case of a successive image formation job in which the size of the recording material is slightly shorter than the circumferential length of the transfer conveyance belt 91, the formulas 6, 7, and 8 are obtained. In a case of a successive image formation job in which the size of the recording material is still shorter than the circumferential length of the transfer conveyance belt 91, the formulas 9, 10, and 11 are obtained.

Mutual relations between the formulas 3 to 5, 6 to 8, and 9 to 11 are noticed. The formulas 3, 4, and 5 can be obtained by assigning N=0 to the formulas 9, 10, and 11, respectively. The formulas 6, 7, and 8 can be obtained by assigning N=1 to the formulas 9, 10, and 11, respectively.

More specifically, the formulas 9, 10, and 11 gives general solutions for the three different cases: a case of a one-sheet job, a case of a successive image formation job in which the size of the recording material is longer than the circumferential length of the transfer conveyance belt 91, and a case of a successive image formation job in which the size of the recording material is shorter than the circumferential length of the transfer conveyance belt 91.

"N" is a positive integer or zero. "N" indicates the number of recording materials and the number of separation assisting toner images to be sandwiched by the separation assisting toner image Ts and the recording material Ps whose detachment is to be assisted by the separation assisting toner image Ts.

At indicates a time interval since the time when the leading edge of the separation assisting toner image Ts on the intermediate transfer belt 51 reaches the secondary transfer nip portion N2 till the time when the leading edge of the recording material Ps whose detachment is to be assisted by the separation assisting toner image Ts reaches the secondary transfer nip portion N2. v indicates the moving speed of the transfer conveyance belt 91. Δt is represented by Δt=(b+e+Nf)/v, as illustrated in FIG. 9. The formula 9 is represented by Δt and v as follows:

$$c<b+e+Nf$$

$$c/v<(b+e+Nf)/v=v\Delta t$$

$$\Delta t>c/v \quad \text{(Formula 12)}$$

The formula 10 is represented by Δt and v as follows:

$$c>e+Nf$$

$$c/v>(e/v)+(Nf/v)$$

$$C/v>\Delta t-(b/v)$$

$$\Delta t<(b/v)+(c/v) \quad \text{(Formula 13)}$$

The formula 11 is represented by Δt and v as follows:

$$c>b+Nf$$

$$c/v>(b/v)+(Nf/v)$$

$$C/v>\Delta t-(e/v)$$

$$\Delta t<(c/v)+(e/v) \quad \text{(Formula 14)}$$

More specifically, the control unit 110 controls the timing of forming the separation assisting toner image T by the image forming unit Sa and the timing of conveying the recording material toward the transfer conveyance belt 91 by the conveyance roller pair 83 so as to satisfy the relations represented by the formulas 12, 13, and 14. As a result, even if images are successively formed on a plurality of recording materials, the recording materials are conveyed so that the rear surface of the leading edge of each recording material overlaps with the separation assisting toner image. As a result, even in the case of a recording material having low stiffness such as thin paper, detachment failure can be prevented from occurring.

As described above, according to the present exemplary embodiment, an image forming apparatus can be realized in which a thin recording material which is hard to be detached from a transfer conveyance belt can be stably detached therefrom. Further, the use of an image forming apparatus satisfying the above-described relations can realize an image forming apparatus in which a recording material can be stably detached from a transfer conveyance belt even in successive image formation.

In addition, the image forming apparatus according to the present exemplary embodiment can be configured to form a separation assisting toner image on the above-described transfer conveyance belt 91 in the case of image formation on a specific type of recording material such as thin paper (thin paper mode), and not to form a separation assisting toner image thereon in the case of image formation on a recording material such as thick paper (thick paper mode). In this case, as illustrated in FIG. 2, a user operation unit 111 selectable by an operator such as a user is provided on the image forming apparatus, and the control unit 110 determines whether a separation assisting toner image is to be formed according to a selected mode. This configuration does not form a separation assisting toner image when a recording material such as thick paper not needing a separation assisting toner image is used, thus toner consumption for forming a separation assisting toner image can be suppressed.

According to the present exemplary embodiment, a separation assisting toner image is formed using a toner of yellow color. Of course, the configuration is not limited thereto. To bring forward the timing of forming a separation assisting toner image giving priority on the productivity of image formation, a separation assisting toner image may be formed by the image forming unit on the most downstream side.

A second exemplary embodiment of the claimed invention will be described below with reference to FIG. 10. An image forming apparatus according to the present exemplary embodiment has almost the same configuration as that according to the first exemplary embodiment except that a transfer conveyance belt 91 is partially differently configured. Therefore, duplicated descriptions will be omitted and only differences in configuration will be described.

The image forming apparatus according to the present exemplary embodiment includes a transfer conveyance belt cleaner 99 as a cleaning member for cleaning the transfer conveyance belt 91. The transfer conveyance belt cleaner 99 is arranged at a position facing the transfer conveyance belt driving roller 92 to remove fogging toner and paper powder adhering to the transfer conveyance belt 91. The transfer conveyance belt cleaner 99 is configured such that a rubber blade made from, for example, urethane abuts against the transfer conveyance belt 91.

The operation of the image forming apparatus according to the present exemplary embodiment will be described in detail below with reference to FIG. 10.

Figure 10:
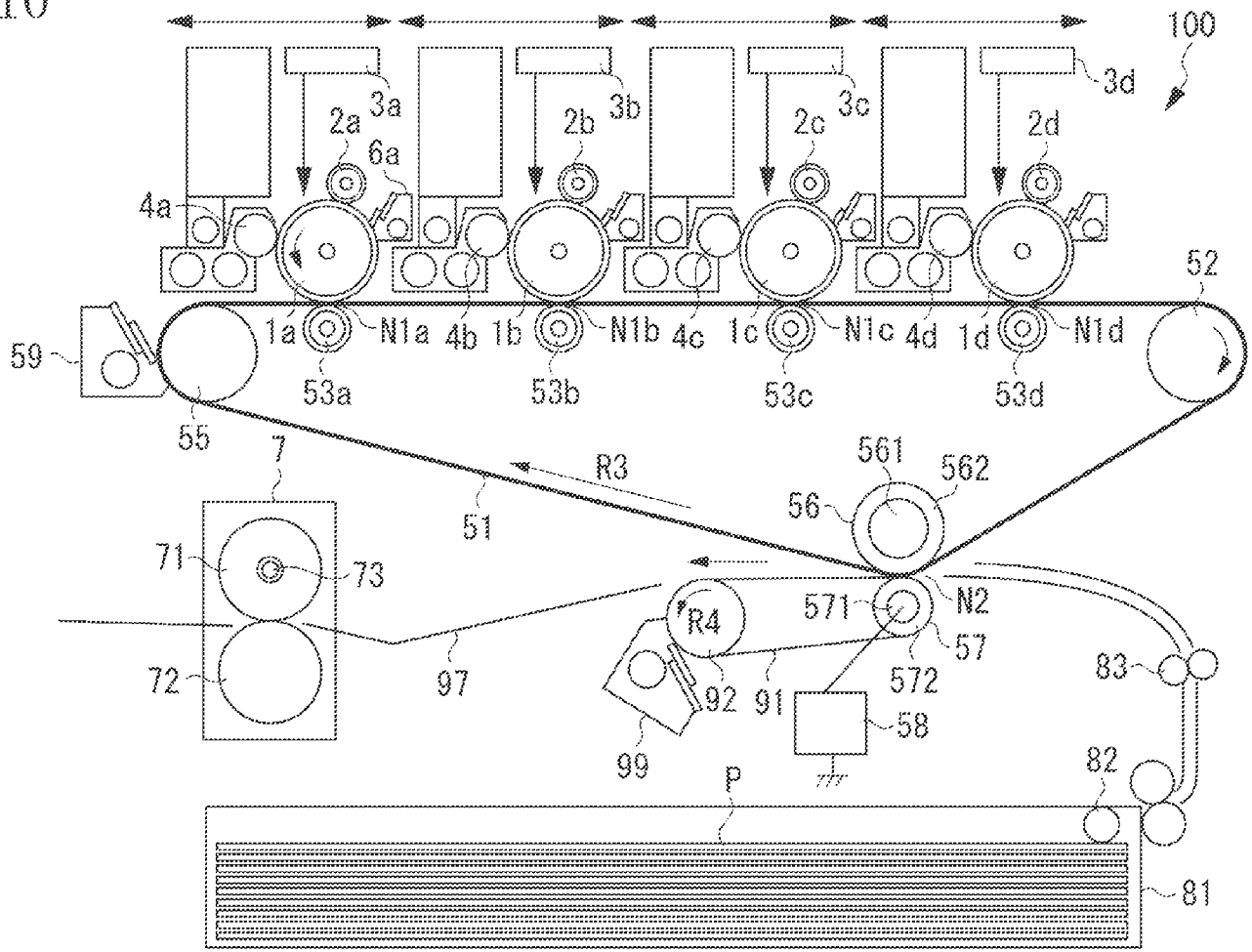
FIG. 10 is a schematic cross sectional view illustrating an image forming apparatus according to another exemplary embodiment of the claimed invention.

Referring to FIG. 10, prior to image formation on the photosensitive drum 1, a separation assisting toner image for assisting the detachment is formed. According to the present exemplary embodiment, a thin layer of a yellow toner is formed on the photosensitive drum 1*a* as a separation assisting toner image.

The separation assisting toner image formed on the photosensitive drum 1*a* is transferred onto the intermediate transfer belt 51 at the primary transfer portion N1*a*. When the separation assisting toner image on the intermediate transfer belt 51 reaches the secondary transfer nip portion N2, a secondary transfer bias voltage is applied to the secondary transfer outer roller 57, and the separation assisting toner image is transferred onto the transfer conveyance belt 91.

The separation assisting toner image transferred onto the transfer conveyance belt 91 is conveyed on the transfer conveyance belt 91 in the rotational direction R4. In this case, the transfer conveyance belt cleaner 99 is separated from the transfer conveyance belt 91 so as not to remove the separation assisting toner image. Meanwhile, the conveyance roller pair 83 as a recording material supply unit conveys the recording material P to the proximity of the transfer conveyance belt 91. Then, the recording material P is synchronously guided so that the leading edge of the recording material P overlaps with the thin layer of the toner formed on the surface of the transfer conveyance belt 91.

Then, when the secondary transfer bias voltage is applied to the secondary transfer outer roller 57, a toner image formed on the intermediate transfer belt 51 is transferred onto the recording material P. Since the separation assisting toner image on the transfer conveyance belt 91 is formed of the toner having a normal polarity (toner charging polarity), the separation assisting toner image is attracted toward the side of the transfer conveyance belt 91 by the secondary transfer voltage. As a result, the separation assisting toner image is prevented from adhering to and smearing the rear surface of the recording material P.

After exiting the secondary transfer nip portion N2, the recording material P is attracted and conveyed by the transfer conveyance belt 91. The recording material P attracted and conveyed by the transfer conveyance belt 91 comes to the position of the transfer conveyance belt driving roller 92. In this case, the adhesiveness between the leading edge of the recording material P and the transfer conveyance belt 91 is low since the separation assisting toner image exists on the rear surface of the leading edge of the recording material P. Therefore, even if the self stripping is not stable because the recording material P is thin paper having low stiffness, the recording material P is prevented from adhering to the transfer conveyance belt 91, and detachment failure can be prevented from occurring at the position of the transfer conveyance belt driving roller 92.

Then, the intermediate transfer belt cleaner 59 abuts against the transfer conveyance belt 91 to collect the separation assisting toner image formed thereon. At the time of successive image formation, the collection process can be performed for each predefined number of sheets, thus a separation assisting toner image can be prevented from adhering to and smearing the rear surface of a recording material.

As described above, according to the present exemplary embodiment, providing the transfer conveyance belt cleaner 99 on the transfer conveyance belt 91 enables ensuring the ease of detachment of a thin recording material and further providing an image forming apparatus free from smear on the rear side of recording materials.

Figure 11:
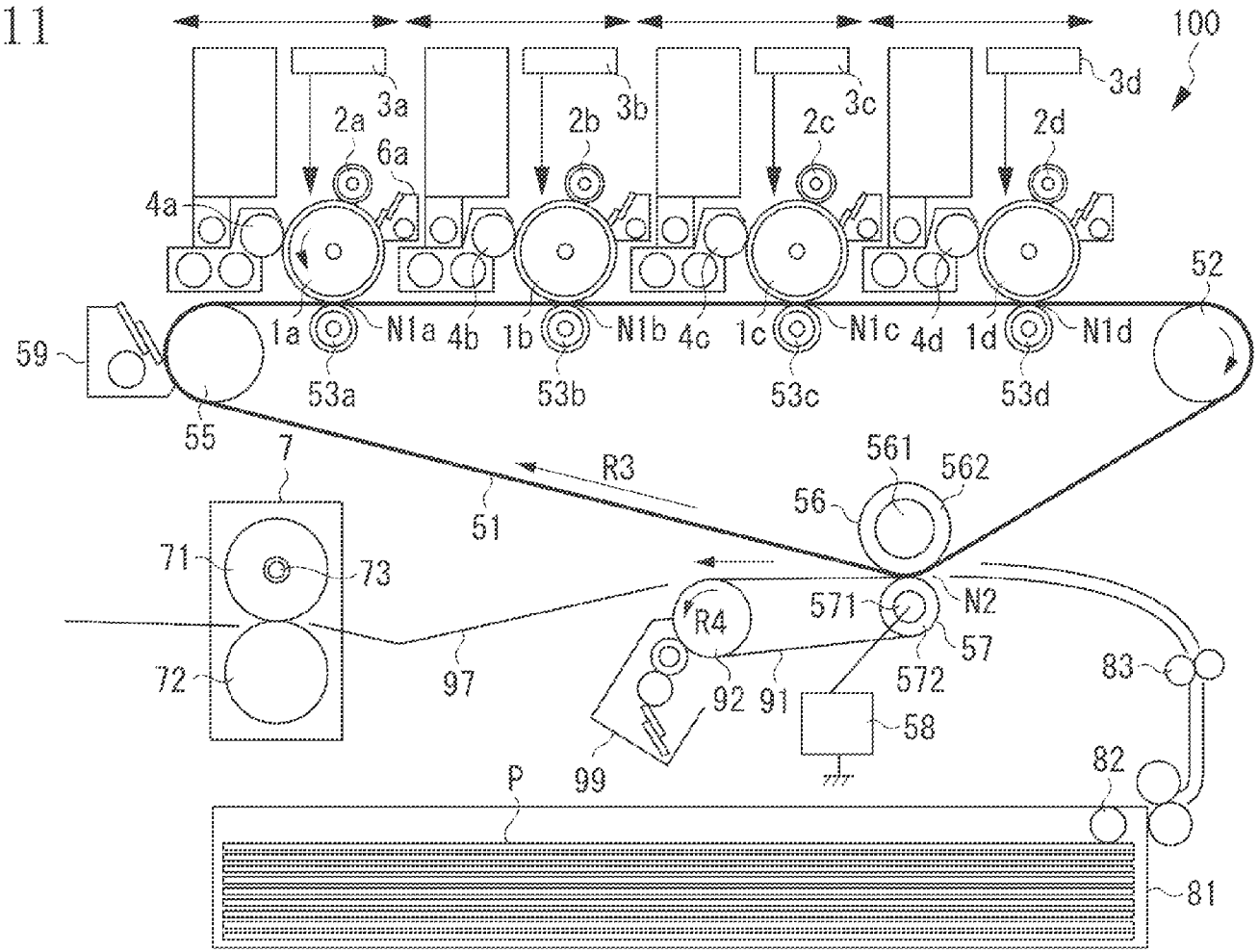
FIG. 11 is a schematic cross sectional view illustrating an image forming apparatus according to another exemplary embodiment of the claimed invention.

Although exemplary embodiments of the claimed invention are specifically described above, the claimed invention is not limited thereto. As illustrated in FIG. 11, the image forming apparatus may be provided with the transfer conveyance belt cleaner 99 including a fur brush contacting the transfer conveyance belt 91 and a cleaning voltage application unit for applying a voltage to the fur brush. More specifically, the cleaning voltage application unit applies a voltage having the opposite polarity of toner to the fur brush to collect the toner on the transfer conveyance belt 91. With this configuration, when the separation assisting toner image passes through the transfer conveyance belt cleaner 99, the control unit 110 turns off the bias voltage to be applied to the fur brush or float the fur brush. As a result, the separation assisting toner image can pass through the fur brush without being collected by the fur brush.

An image forming apparatus according to a third exemplary embodiment of the claimed invention employs a direct multi transfer method, and performs similar control to the first exemplary embodiment by a transfer conveyance belt.

Figure 12:
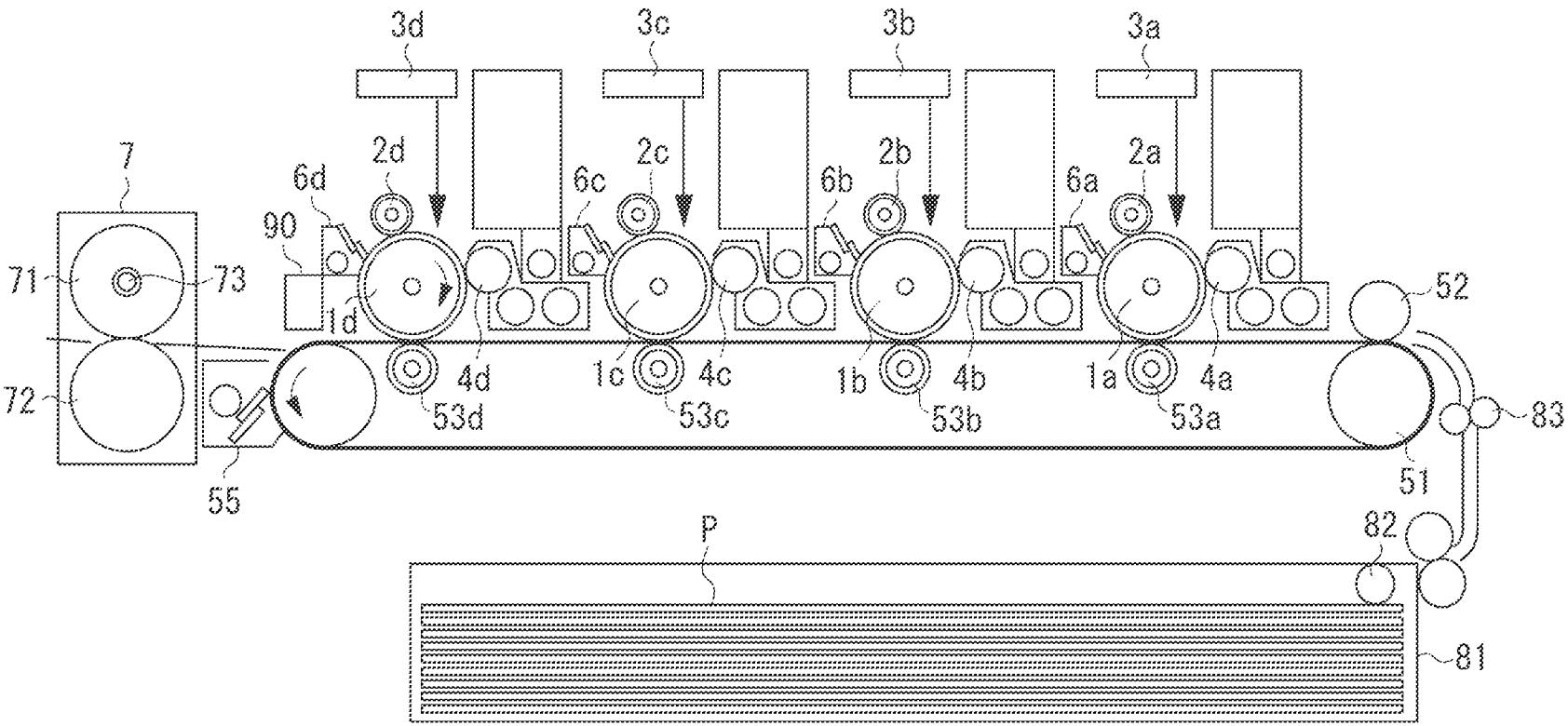
FIG. 12 is a schematic cross sectional view illustrating an image forming apparatus according to another exemplary embodiment of the claimed invention.

FIG. 12 schematically illustrates the proximity of image bearing members of the image forming apparatus according to the present exemplary embodiment. As illustrated in FIG. 12, the image forming apparatus according to the present exemplary embodiment includes four process units serving as image forming units, each including a charging unit, an exposure unit, a developing device, and a cleaner around a photosensitive drum as a latent image bearing member. Images formed on the photosensitive drums by the respective process units are successively transferred in a multi-layer way onto a recording material such as paper on a moving conveyance member (i.e., the transfer conveyance belt) adjacent to the photosensitive drums. Thus a full-color image is formed.

The image forming apparatus according to the present exemplary embodiment will be described in detail below. The process units Pa, Pb, Pc, and Pd for forming images of yellow, magenta, cyan, and black colors respectively include photosensitive drums 1*a*, 1*b*, 1*c*, and 1*d*. Each photosensitive drum is rotatable in the direction indicated by an arrow. Around the photosensitive drums 1*a*, 1*b*, 1*c*, and 1*d*, charging unit 2*a*, 2*b*, 2*c*, and 2*d*, exposure units 3*a*, 3*b*, 3*c*, and 3*d*, developing devices 4*a*, 4*b*, 4*c*, and 4*d*, and cleaners 6*a*, 6*b*, 6*c*, and 6*d* are arranged, respectively, along the rotational direction of respective photosensitive drums.

The configuration of each process unit is similar to that in the first exemplary embodiment, and duplicated descriptions will be omitted.

Referring to FIG. 12, a recording material P supplied from a sheet cassette 81 as a recording material supply unit is supplied to a conveyance roller pair 83 via a pickup roller 82, electrostatically sucked onto a transfer conveyance belt 51 via an absorbing unit 52, and conveyed to a bottom portion of each process unit. A transfer bias voltage is applied to toner images of the respective colors formed on the photosensitive drums 1*a*, 1*b*, 1*c*, and 1*d* by the respective transfer rollers 53*a*, 53*b*, 53*c*, and 53*d* facing across the recording material P and the transfer conveyance belt 51. Then, the toner images are successively transferred onto the recording material P. Upon completion of the transfer process, the recording material P is detached from the transfer conveyance belt 51 and then conveyed to a fixing device 7. The toner on the transfer conveyance belt 51 is removed and collected by a transfer conveyance belt cleaner 55.

The fixing device 7 includes a fixing roller 71 rotatably arranged and a pressing roller 72 rotating while press-contacting with the fixing roller 71. The fixing roller 71 further includes a heater 73 such as a halogen lamp. The temperature of the surface of the fixing roller 71 is controlled by controlling a voltage to be supplied to the heater 73. In this state, when the recording material P is conveyed to the fixing device 7, the fixing roller 71 and the pressing roller 72 starts rotating at a constant speed. When the recording material P passes through between the fixing roller 71 and the pressing rollers 72, the fixing roller 71 and the pressing rollers 72 respectively apply heat and pressure to the recording material P at almost constant temperature and pressure from both sides of the recording material P. As a result, an unfixed toner image on the surface of the recording material P is melted and fixed onto the recording material P. Thus, a full-color image is formed on the recording material P.

The transfer conveyance belt 51 is formed of a dielectric resin such as PC, PET, PVDF, etc. According to the present exemplary embodiment, the transfer conveyance belt 51 is formed of a carbon-dispersed PI resin having a volume resistivity of $10^{14}\Omega\cdot$cm (measured by using a probe conforming to the JIS-K6911 standard, a 1000 V voltage applied for 60 seconds at 23° C. and 50% RH) and a thickness t of 80 μm.

Each of the transfer rollers 53 is formed of a core having an outer diameter of 8 mm and a conductive urethane sponge layer having a thickness of 4 mm. The electrical resistance value of the transfer rollers 53 is obtained based on a current value measured by rotating the transfer rollers 53 at a circumferential speed of 50 mm/sec for the grounding under a 500 gram weight load and applying a 500 V voltage to the core. The electrical resistance value of the transfer rollers 53 was about $10^{6.5}\Omega$ (at 23° C. and 50% RH).

Also in the above-described configuration, after a separation assisting toner image is formed on the transfer conveyance belt 51, the control unit 110 performs control so that the rear surface of the leading edge of the recording material P overlaps with the separation assisting toner image. In this case, the adhesiveness between the leading edge of the recording material P and the transfer conveyance belt 51 is low since the separation assisting toner image exists on the rear surface of the leading edge of the recording material P. Therefore, even if the self stripping is not stable when the recording material P is thin paper having low stiffness, the recording material P is prevented from adhering to the transfer conveyance belt 51, and detachment failure can be prevented from occurring at the position of a transfer conveyance belt driving roller.

While the claimed invention has been described with reference to exemplary embodiments, it is to be understood that the claimed invention is not limited to the disclosed exemplary embodiments. The scope of the following claims is to be accorded the broadest interpretation so as to encompass all modifications, equivalent structures, and functions.

This application claims priority from Japanese Patent Application No. 2011-225102 filed Oct. 12, 2011, which is hereby incorporated by reference herein in its entirety.

What is claimed is:

1. An image forming apparatus comprising:

a movable image bearing member;

an image forming unit configured to form a toner image on the image bearing member;

a movable endless conveyance belt configured to bear and convey a recording material;

a transfer member configured to transfer, in a transfer portion, the toner image formed on the image bearing member onto a recording material supported by the conveyance belt; and a control unit configured to control a timing of feeding a recording material to the conveyance belt so that a part of the recording material including at least a leading edge of the recording material overlaps with a toner layer, the toner layer being transferred in advance to the conveyance belt from the image bearing member, and having a charging polarity when the toner layer passes the transfer portion, being the same as a charging polarity of the toner image transferred from the image bearing member onto the recording material, and having a length such that, when the part of the recording material including at least a leading edge of the recording material overlaps with the toner layer, the other part of the recording material does not overlap with the toner layer.

2. The image forming apparatus according to claim 1, wherein, in a mode in which a plurality of images is successively formed, the control unit controls a timing of forming the toner layer and a timing of feeding a recording material to the conveyance belt so as to satisfy conditions $$c<Nf+b+e, \text{ and}$$

$$Nf+e<c$$

where "b" indicates a length of the toner layer in the moving direction of the conveyance belt, "c" indicates a length of the conveyance belt in the moving direction of the conveyance belt, "e" indicates a distance from a trailing edge of the toner layer in a state not overlapping with a recording material to a leading edge of a recording material following the toner layer in the moving direction of the conveyance belt, "f" indicates a distance from a leading edge of a recording material to a leading edge of a following recording material in the moving direction of the conveyance belt, and "N" is a positive integer or zero.

3. The image forming apparatus according to claim 1, wherein, in a mode in which a plurality of images is successively formed, the control unit controls a timing of forming the toner layer and a timing of feeding a recording material to the conveyance belt so as to satisfy conditions $$c<Nf+b+e, \text{ and}$$

$$Nf+e<c$$

where "b" indicates a length of the toner layer in the moving direction of the conveyance belt, "c" indicates a length of the conveyance belt in the moving direction of the conveyance belt, "e" indicates a distance from a trailing edge of the toner layer in a state not overlapping with a recording material to a leading edge of a recording material following the toner layer in the moving direction of the conveyance belt, "f" indicates a distance from a leading edge of a recording material to a leading edge of a following recording material in the moving direction of the conveyance belt, and "N" is a positive integer or zero.

4. The image forming apparatus according to claim 1, wherein the image forming unit is capable of forming a toner image using toner of a plurality of colors, and wherein the control unit forms the toner layer using toner of a color having a highest lightness.

5. The image forming apparatus according to claim 1, wherein the control unit controls the image forming unit so that an amount per unit area of the toner layer is 0.01 $mg/cm^2$ or more and 0.04 $mg/cm^2$ or less on the conveyance belt.

6. The image forming apparatus according to claim 1, further comprising:

a transfer power supply configured to apply a voltage to the transfer member, wherein, if a toner image is transferred from the image bearing member onto a recording material borne by the conveyance belt, the control unit controls the transfer power supply to output a voltage having a first absolute value, and if the toner layer is transferred from the image bearing member to the conveyance belt, the control unit controls the transfer power supply to output a voltage having a second absolute value which is smaller than the first absolute value.

7. The image forming apparatus according to claim 6, further comprising:

an image bearing member cleaning member configured to contact the image bearing member, wherein, when a voltage having the opposite polarity of the toner charging polarity is not applied by the transfer power supply, the control unit controls the transfer power supply to apply a voltage having the same polarity as the toner charging polarity to move the toner layer on the conveyance belt onto the image bearing member, and cleans the moved toner layer on the image bearing member by the image bearing member cleaning member.

8. The image forming apparatus according to claim 1, further comprising:

a cleaning member configured to contact and clean the conveyance belt by a cleaning member, wherein, while the toner layer is passing through the cleaning member, the control unit controls the cleaning member so as to separate from the conveyance belt.

9. The image forming apparatus according to claim 1, further comprising:

a cleaning member configured to contact and electrostatically clean the conveyance belt at a cleaning portion; and a cleaning power supply configured to apply a voltage having an opposite polarity of a toner charging polarity to the cleaning member to clean the conveyance belt, wherein, while the toner layer is passing through the cleaning portion, the control unit controls the cleaning power supply to output a voltage having the same polarity as the toner charging polarity.

10. The image forming apparatus according to claim 1, further comprising:

a cleaning member configured to contact and electrostatically clean the conveyance belt at a cleaning portion; and a cleaning power supply configured to apply a voltage having an opposite polarity of a toner charging polarity to the cleaning member to clean the conveyance belt, wherein, while the toner layer is passing through the cleaning portion, the control unit turns off a voltage to be applied by the cleaning power supply.

11. The image forming apparatus according to claim 1, wherein, before the toner layer on the conveyance belt goes round with movement of the conveyance belt, the control unit controls a timing of feeding a recording material to the conveyance belt so that a leading edge position of the recording material overlaps with the toner layer.

12. The image forming apparatus according to claim 1, wherein the image forming unit includes a plurality of image forming units arranged in a moving direction of the image bearing member and configured to form respective toner images of different colors, and wherein the control unit forms the toner layer using a most downstream side image forming unit of the plurality of image forming units in the moving direction of the image bearing member.

13. An image forming apparatus comprising:

a movable image bearing member;

an image forming unit configured to form a toner image on the image bearing member;

a movable endless conveyance belt configured to bear and convey a recording material;

a transfer member configured to transfer a toner image formed on the image bearing member onto a recording material supported by the conveyance belt;

a control unit configured to control a timing of feeding a recording material to the conveyance belt so that a part of the recording material including at least a leading edge of the recording material overlaps with a toner layer, the toner layer being transferred in advance to the conveyance belt from the image bearing member, and having a charging polarity being the same as that of a toner image transferred from the image bearing member onto the recording material, and having a length such that, when the part of the recording material including at least a leading edge of the recording material overlaps with the toner layer, the other part of the recording material does not overlap with the toner layer; and an operation unit configured to enable an operator to select any one of a plurality of modes according to a type of a recording material to be used, wherein the control unit forms the toner layer if the operator selects a mode in which a thin recording material is used, and does not form the toner layer if the operator selects a mode in which a thick recording material is used.

* * * * *